US006200093B1

(12) United States Patent
Lee et al.

(10) Patent No.: US 6,200,093 B1
(45) Date of Patent: Mar. 13, 2001

(54) SIROCCO FAN

(75) Inventors: Joon Sei Lee, Seoul; Sung Il Park, Kyungki-do, both of (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/311,286

(22) Filed: May 14, 1999

(30) Foreign Application Priority Data

Dec. 2, 1998 (KR) ..... 98-52544
Dec. 17, 1998 (KR) ..... 98-55782

(51) Int. Cl.[7] ..... F01D 1/02
(52) U.S. Cl. ..... 415/204; 415/206; 415/212.1
(58) Field of Search ..... 415/203, 204, 415/206, 212.1

(56) References Cited

U.S. PATENT DOCUMENTS 5,813,834 * 9/1998 Hopfensperger et al. ..... 415/204
5,839,879 * 11/1998 Kameoka et al. ..... 415/206

* cited by examiner

*Primary Examiner*—Edward K. Look
*Assistant Examiner*—Hermes Rodriguez

(57) ABSTRACT

A dual-intake fan which is a so-called sirocco fan used for venting air is disclosed. The fan has a structure in which a portion of an exhaust outlet is formed to be inclined while the centers of a scroll housing and an impeller are disposed to be eccentric so that noise can be reduced while air flow can be effectively guided by the scroll housing to the maximum extent and the air flow rate can be increased. The fan includes an impeller on which a plurality of blades are installed for rotating so as to create air flow, and a scroll housing formed so that the air drawn in through an air inlet by the impeller can be guided along a gradually expanding passage of the scroll housing, and the lower portion of an exhaust outlet is composed of at least one incline formed to be inclined upward toward any one side. In addition, the rotation center of the impeller and the center of the air inlet are disposed to be eccentric.

5 Claims, 9 Drawing Sheets

SIROCCO FAN

BACKGROUND OF THE INVENTION

1. Field of the Invention

The present invention relates to a dual-intake fan which is a so-called sirocco fan used for venting air, and more particularly, to a fan having a structure in which a portion of an exhaust outlet is formed to be inclined while the centers of a scroll housing and an impeller are disposed to be eccentric so that noise can be reduced while air flow can be effectively guided by the scroll housing to the maximum extent and the air flow rate can be increased.

2. Description of the Related Art

In general, a fan, as a device which generates air flow, is widely used in various equipments and facilities. In particular, in a microwave oven provided with a fume hood, which is used in a domestic kitchen, a fan is installed at an upper portion of the microwave oven so as to vent odors and smoke generated in a gas range installed below the microwave oven. That is, as shown in FIGS. 1 and 2, after the odors and smoke generated in the gas range are drawn into the lower part of the microwave oven, the odor and smoke are taken into a fan 10 along air flow passages, and then are vented to the outside through an exhaust outlet 10*a* of the fan 10. Here, the exhaust outlet 10*a* of the fan 10 may be installed as shown FIG. 2, or may be configured so that the exhaust outlet 10*a* is installed to face upward and the odors and smoke can be vented to the outside by connecting a duct to the exhaust outlet 10*a*. As a matter of course, in the microwave provided with the fume hood, a magnetron 2 for generating an electromagnetic wave so as to cook food supplied into a cooking chamber 1*a*, and a fan 3 for cooling the magnetron 2. Reference numerals 1, 4, and 11 indicate a case, a door and a motor, respectively.

FIG. 3 shows a front view of a conventional fan, FIG. 4 shows a left side view of the fan shown in FIG. 3, FIG. 5 shows a left side view of the fan shown in FIG. 3 illustrating a flow velocity distribution measured by a laser Doppler velocimeter (LDV) at the exhaust outlets of the fan, and FIG. 6 shows a front view of the fan shown in FIG. 3, in which a flow velocity distribution at an air inlet of the fan is expressed by velocity vectors.

As shown in FIGS. 3 and 4, a conventional fan 20 comprises impellers 21 for rotating so as to create air flow, scroll housings 22 for guiding the flow of air drawn by the impeller 21, bell mouths installed around air inlets 22*a* formed at the scroll housings 22 for guiding intake air flow.

Here, the impeller 21 comprises a plurality of blades 21*a* for rotating so as to create air flow, rims 21*b* installed at both ends of the blades 21*a* for supporting the blades, and a separating member 21*c* connected to a motor 30 as a driving means while connected to center portions of the blades.

In addition, the air inlets 22*a* are formed at the motor side and the flow passage side of the scroll housing 22, and an exhaust outlet 22*b* for venting the air drawn into the scroll housing 22 through the air inlets 22 is formed at the scroll housing 22. Here, the reference location or boundary location of the exhaust outlet 22*b* is called a cutoff C'.

In the above structure, when the motor 30 is supplied with electric power and the impeller 21 rotates, air is drawn in through the air inlet 22*b* by the pressure due to the rotation of the impeller 21. After the drawn air is moved to the exhaust outlet 22*b* in accordance with the guidance of the scroll housing 22 having a gradually expanding passage from the cutoff C', the air is vented to the outside. That is, the entering air to which the dynamic energy is imparted by the blades 21*a*, the air is vented to the outside through the exhaust outlet 22*b* while recovering static energy from the dynamic energy.

Reference numerals S' and I' indicate the center of the air inlet 22*a* of the scroll housing 22*a* and the rotation center of the impeller 21, respectively.

However, in the conventional fan 20, since the exhaust outlet 22*b* of the scroll housing 22 has a rectangular shape parallel to the rotating shaft of the impeller 21, it was found that relatively large flow loss occurs at the edge portions, i.e., the peripheral portions of the exhaust outlet 22*b* as shown in FIG. 5, as a result of an experiment of measuring a flow velocity distribution at the exhaust outlet 22*b* with the laser Doppler velocimeter. In other words, the air flow having a recovered pressure, i.e., raised static energy while flowing along the scroll housing 22 forms a wide flow loss area due to the growth of boundary layers at the edge portions of the exhaust outlet 22*b*. Accordingly, there are problems in which while such flow loss at the exhaust outlet reduces the air flow rate, the lost energy is converted into noise and increases noise.

In addition, since the conventional fan 20 is designed so that the center I' of the impeller is simply coincident with the center S' without considering the flow velocity distribution at the air inlet 22*a*, as shown in FIG. 6 when examining the flow velocity distribution at the air inlet 22*a* of the fan, there is a problem in which a flow loss area L is formed in an area where the rotation angle θ' is in the range from −90° to 90° when examined in terms of the rotation angle θ'.

SUMMARY OF THE INVENTION

To solve the above problems, it is an objective of the present invention to provide a fan capable of increasing the air flow rate and simultaneously reducing noise by disposing the center of an impeller to be eccentric with respect to the center of a scroll housing and forming the lower portion of an exhaust outlet of the scroll housing to be inclined so that the formation of a flow loss area can be prevented.

Accordingly, to achieve the above objective, there is provided a fan including an impeller on which a plurality of blades are installed for rotating so as to create air flow, and a scroll housing formed so that the air drawn in through an air inlet by the impeller can be guided along a gradually expanding passage of the scroll housing, and the lower portion of an exhaust outlet is composed of at least one incline formed to be inclined upward toward any one side.

In addition, there is provided a fan including an impeller on which a plurality of blades are installed for rotating so as to create air flow, and a scroll housing formed so that the air drawn in through an air inlet by the impeller can be guided along a gradually expanding passage of the scroll housing, and the rotation center of the impeller and the center of the air inlet can be disposed to be eccentric.

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Figure 7:
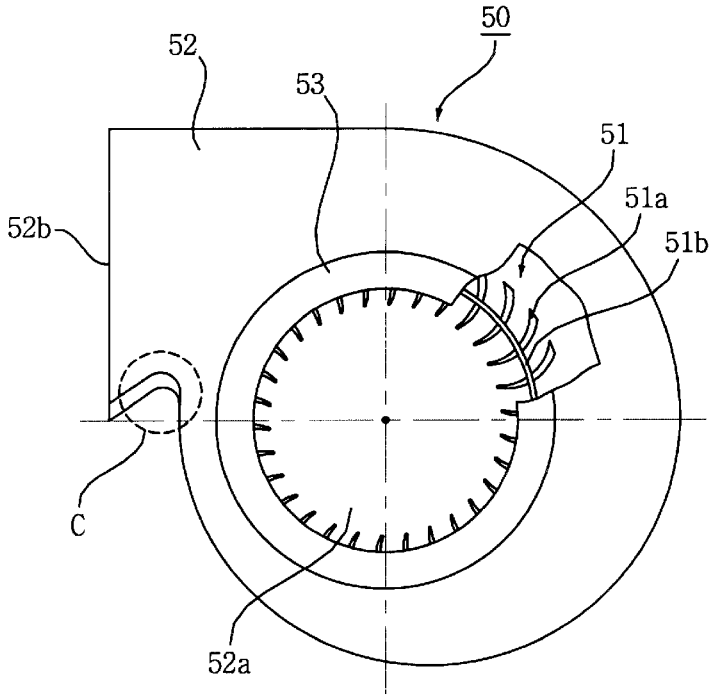
FIG. 7 is a front view illustrating a fan according to a first embodiment of the present invention.
Figure 8:
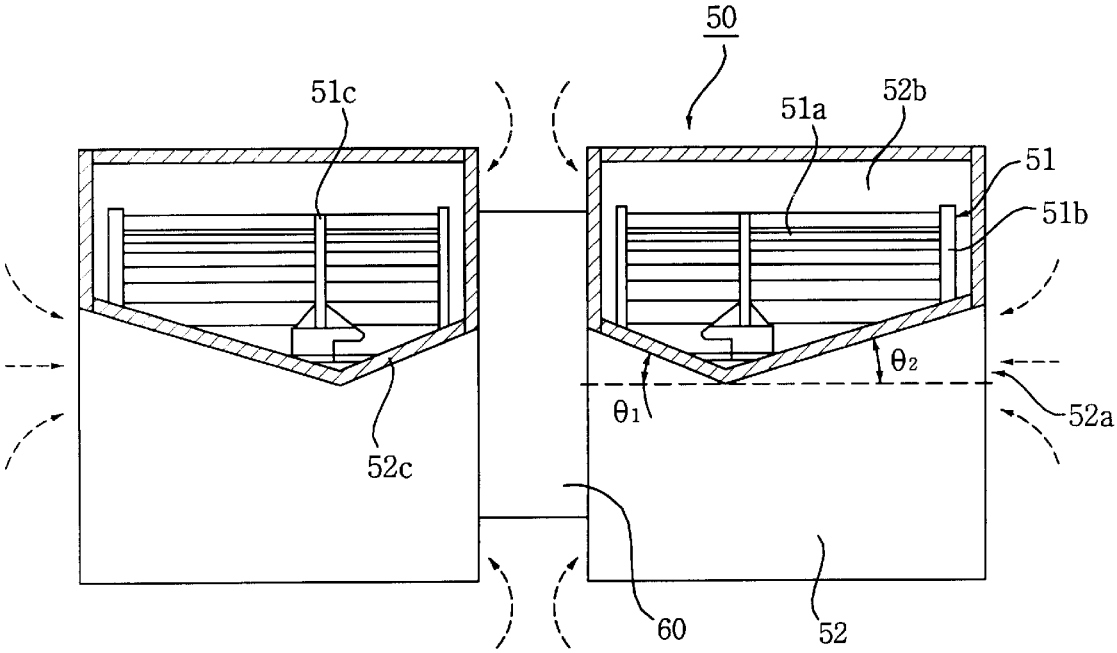
FIG. 8 is a left side view illustrating the fan according to the first embodiment of the present invention.
Figure 9:
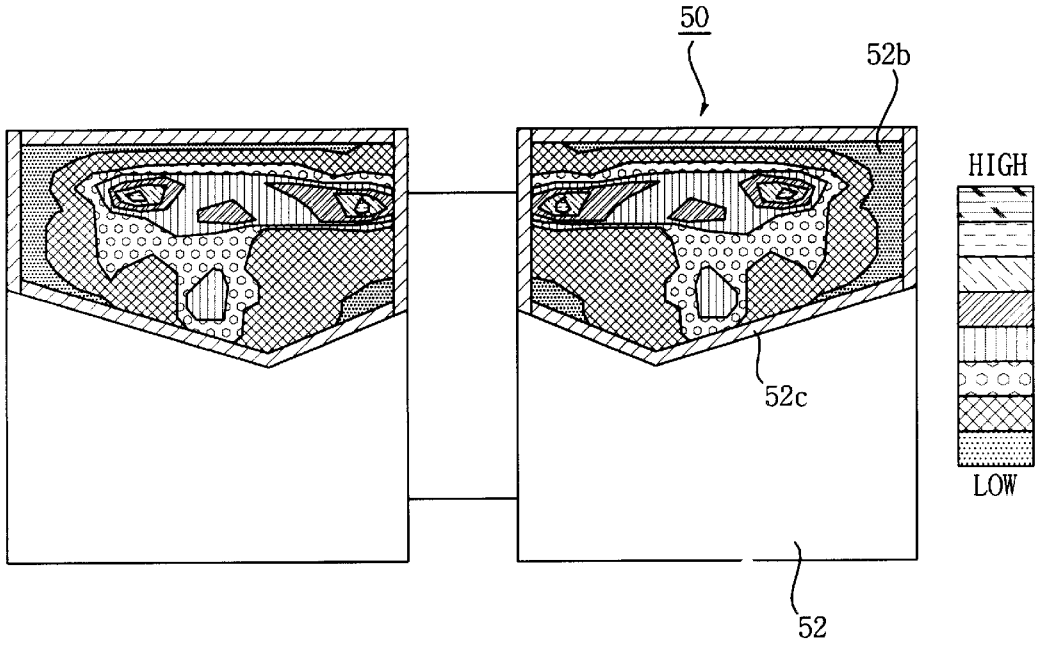
FIG. 9 is a left side view of the fan according to the first embodiment of the present invention illustrating a flow velocity distribution measured by the laser Doppler velocimeter at the exhaust outlets of the fan.

FIG. 7 is a front view illustrating a fan according to a first embodiment of the present invention, FIG. 8 is a left side view illustrating the fan according to the first embodiment of the present invention, and FIG. 9 is a left side view of the fan according to the first embodiment of the present invention illustrating a flow velocity distribution measured by a laser Doppler velocimeter at the exhaust outlets of the fan.

As shown in FIGS. 7 and 8, a fan 50 according to a first embodiment of the present invention comprises an impeller 51 for rotating so as to create air flow, a scroll housing 52 for guiding the air flow created by the impeller 51, and a bell mouth 53 installed around an air inlet of the scroll housing 52 for guiding the entering air flow.

Here, the impeller 51 comprises a plurality of blades 51*a*, rims 51*b* for supporting the blades 51*a*, and a separating member 51*c* connected to portions of the blades 51*a* and a motor 60 as a driving means. The scroll housing 52 is provided with the air inlets 52*a* formed at the motor 60 side and the opposite side thereof, and an oulet for guiding and venting the air drawn in through the air inlet 52*a*.

In particular, the lower portion 52*c* of the exhaust outlet 52*b* is formed in a V shape having two inclines inclined upward toward both side directions taking the separating member 51*c* as a reference plane, and the angle of inclination $\theta_1$ of the motor 60 side is about 38° and the angle of inclination $\theta_2$ of the opposite incline is about 21°.

In the above structure, when the driving force of the motor 60 is transferred to the impeller 51 and the impeller 51 rotates, after the air drawn in through the air inlet 52*a* is moved to the exhaust outlet 52*b* along a flow passage gradually expanding from a cutoff C of the scroll housing 52, the air is vented to the outside. At this time, results shown in FIG. 9 were obtained as a result of an experiment of measuring a flow velocity distribution at the oulet 52*b* with the laser Doppler velocimeter. That is, it was found that portions of high velocities were increased and portions of low velocities were decreased at the exhaust outlet 52*b* in comparison with the conventional fan. Such increases in flow velocities could be obtained by preventing the formation of a flow loss area due to the growth of boundary layers at the edge portions of the exhaust outlet.

Figure 1:
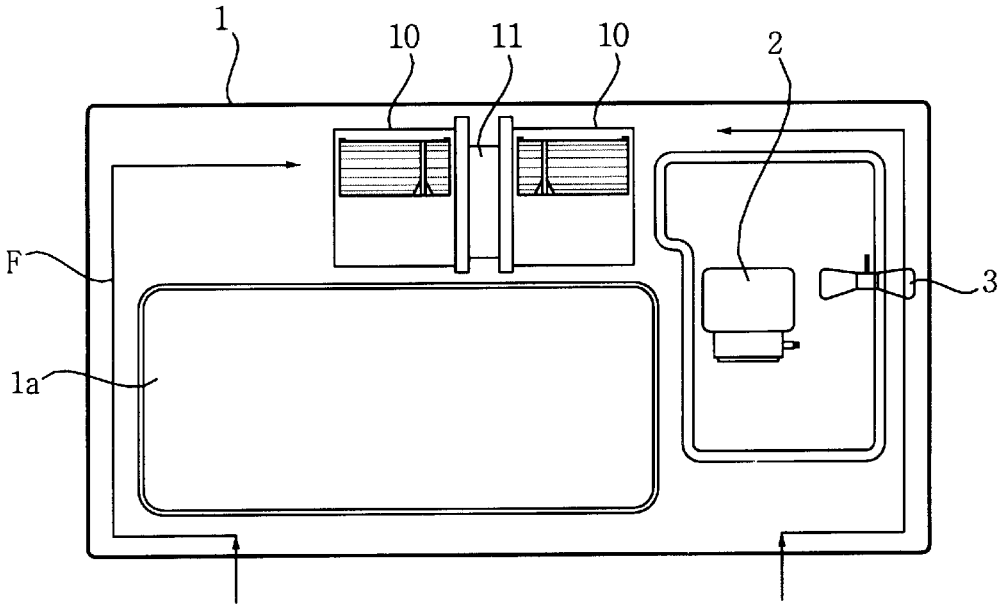
FIG. 1 is a schematic front view illustrating a microwave oven provided with a hood.
Figure 2:
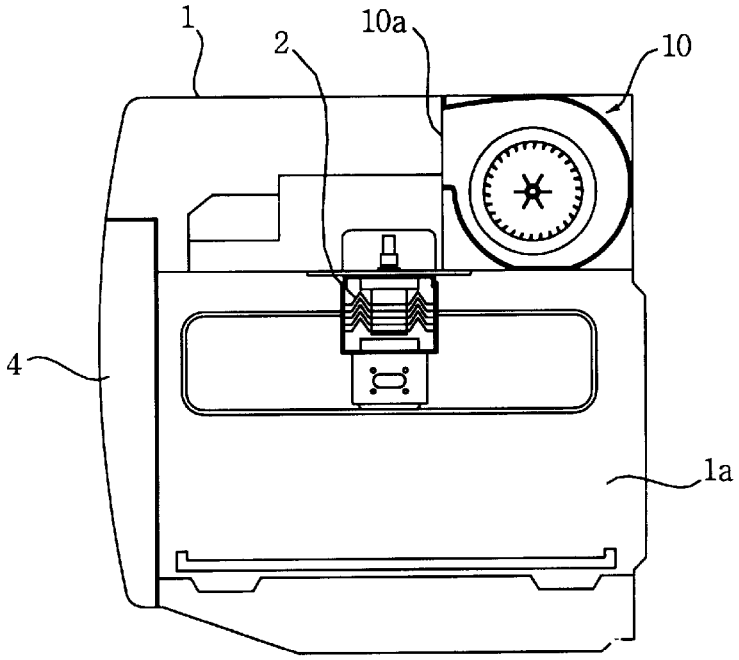
FIG. 2 is a right side view illustrating the microwave oven shown in FIG. 1.
Figure 3:
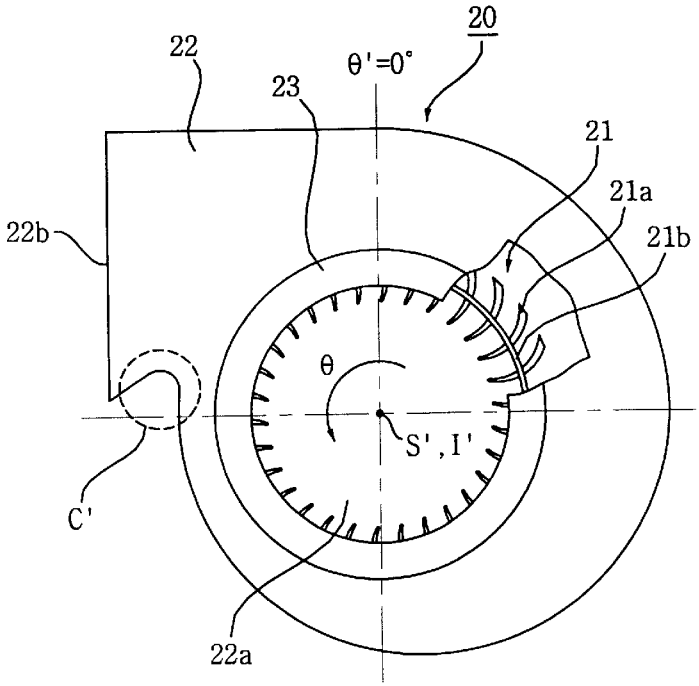
FIG.3 PRIOR ART
FIG. 3 is a front view illustrating a conventional fan.
Figure 4:
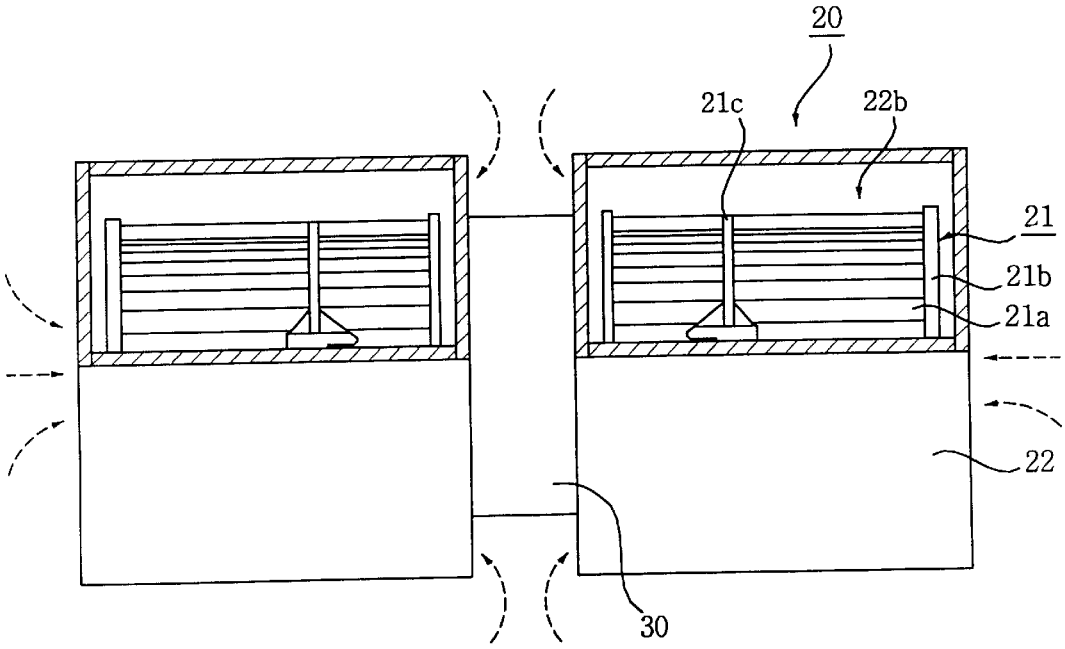
FIG.4 PRIOR ART
FIG. 4 is a left side view illustrating the conventional fan shown in FIG. 3.
Figure 5:
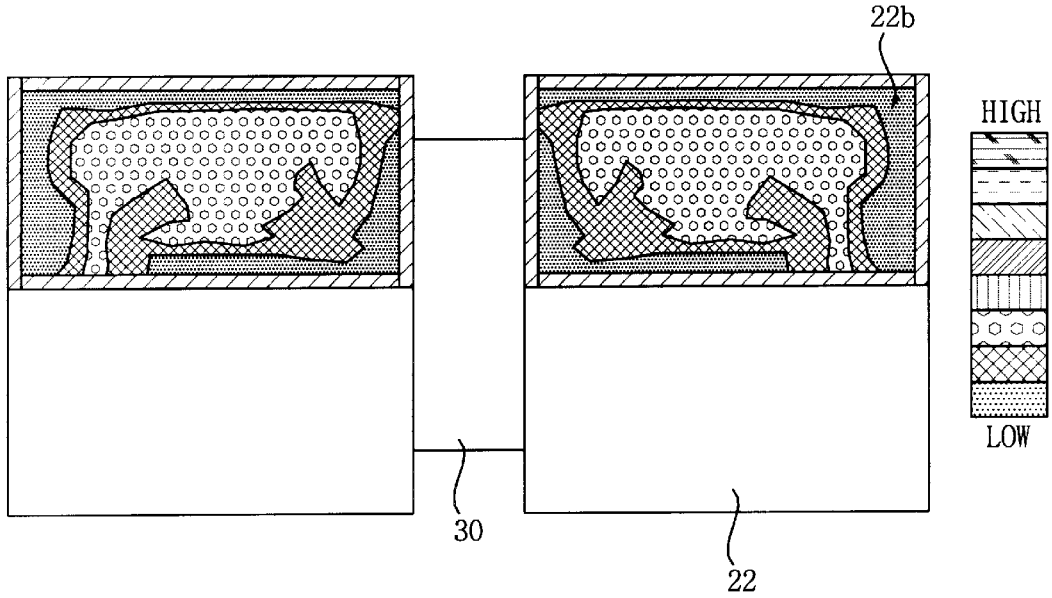
FIG. 5 is a left side view of the fan shown in FIG. 3 illustrating a flow velocity distribution measured by a laser Doppler velocimeter (LDV) at the exhaust outlets of the fan.
Figure 6:
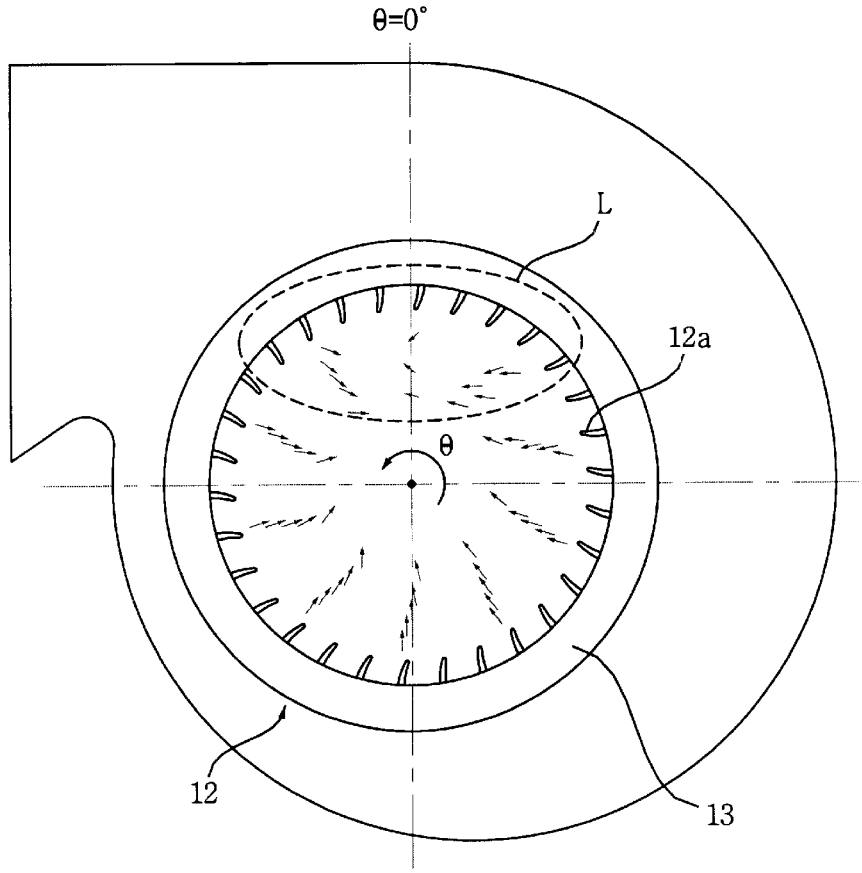
FIG. 6 is a front view of the fan shown in FIG. 3, in which a flow velocity distribution at an air inlet of the fan is expressed by velocity vectors.
Figure 10:
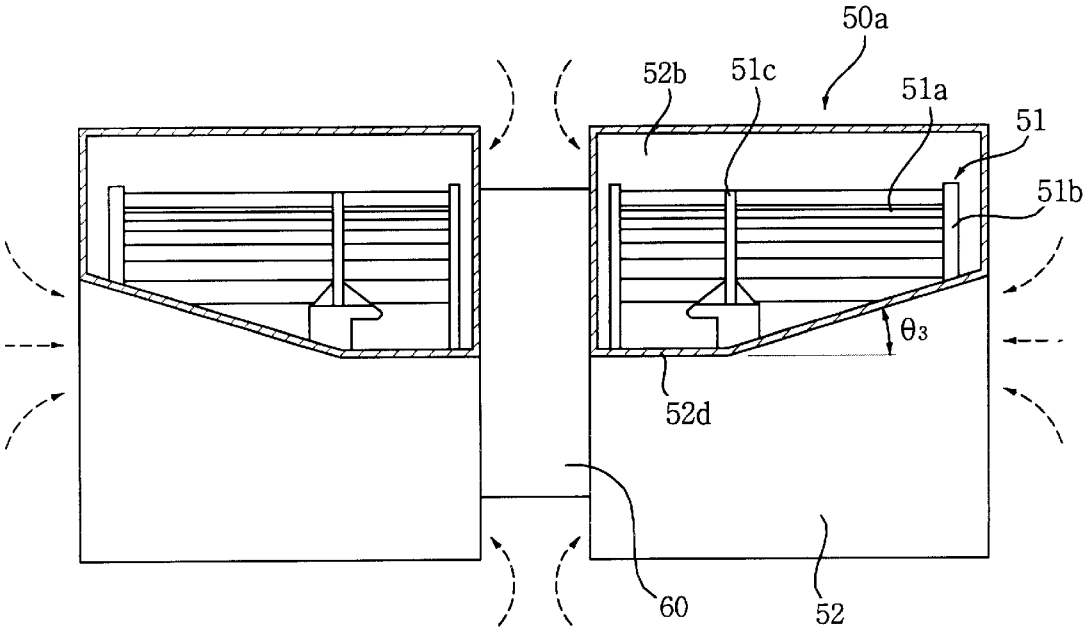
FIG. 10 is a left side view illustrating a fan according to a second embodiment of the present invention.
Figure 12:
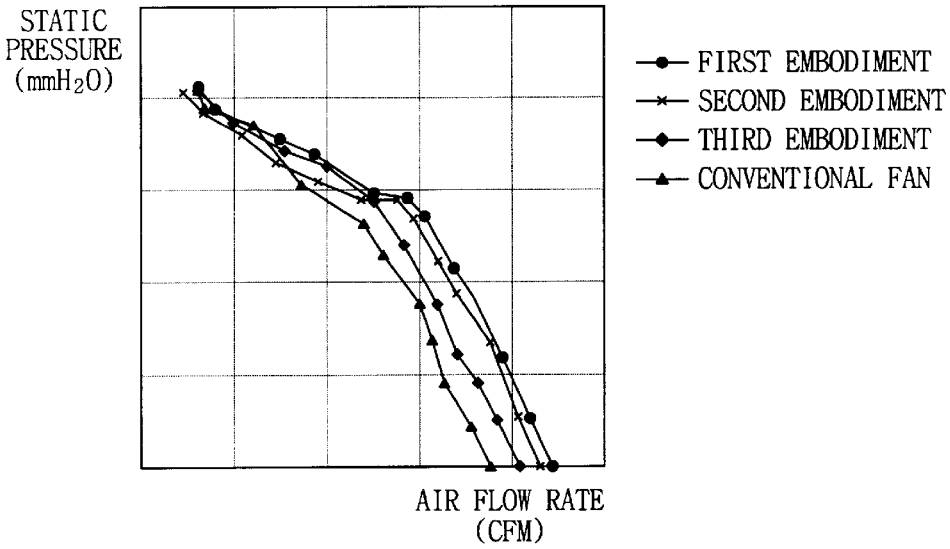
FIG. 12 is a graph illustrating variations of static pressure values versus air flow rates in the fans according to the first, second and third embodiments of the present invention and the conventional fan.
Figure 13:
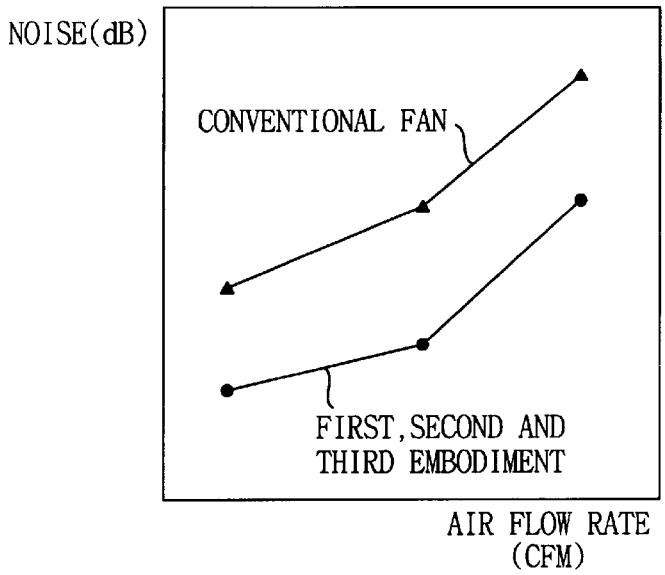
FIG. 13 is a graph illustrating variations of noise values versus air flow rates in the fans according to the first, second and third embodiments of the present invention and the conventional fan.

FIG. 10 is a left side view illustrating a fan according to a second embodiment of the present invention, FIG. 1 is a left side view illustrating a fan according to a third embodiment of the present invention, FIG. 12 is a graph illustrating variations of static pressure values versus air flow rates in the fans according to the first, second and third embodiments of the present invention and the conventional fan, and FIG. 13 is a graph illustrating variations of noise values versus air flow rates in the fans according to the first, second and third embodiments of the present invention and the conventional fan.

As shown in FIG. 10, in a fan 50*a* according to a second embodiment of the present invention, a part of the lower portion 52*d* of the exhaust outlet 52*b* is formed to be horizontal and the other part is formed to be inclined. That is, the lower portion 52*d* of the exhaust outlet 52*b* is formed so that the angle of inclination of the motor 60 side portion is 0° and the angle of inclination $\theta_3$ of the opposite side portion is about 21°. In this case, while the increase in the air flow rate can be obtained much the same as in the first embodiment, there is an advantage in which the design of a die is very easily carried out when the scroll housing 52 is manufactured.

Figure 11:
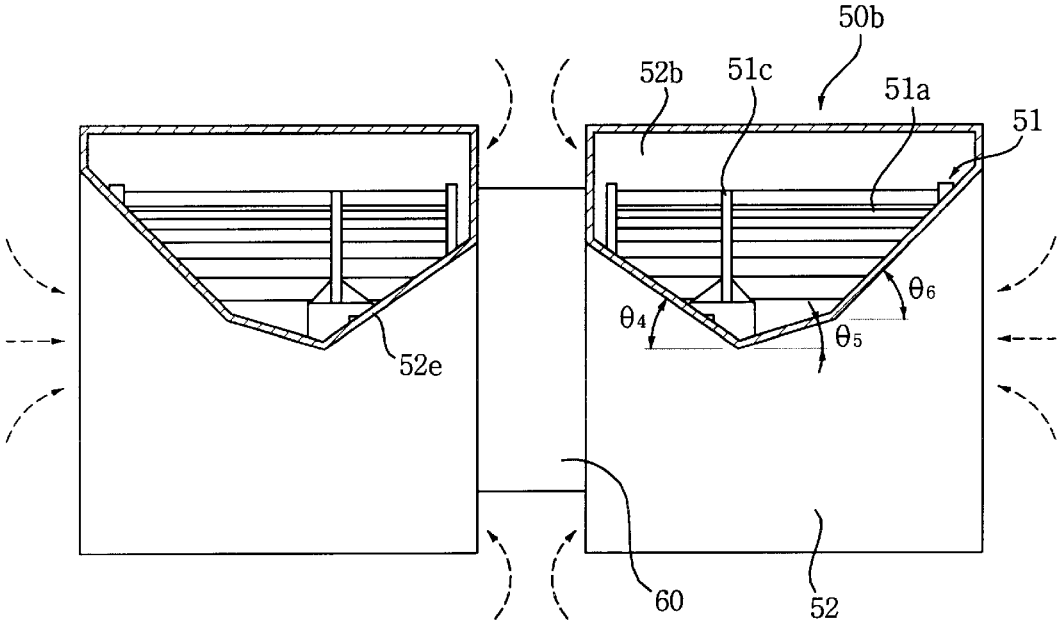
FIG. 11 is a left side view illustrating a fan according to a third embodiment of the present invention.

On the other hand, as shown in FIG. 11, in a fan 50*b* according to a third embodiment of the present invention, the lower portion 52*e* of the exhaust outlet 52*b* is formed so that the angle of inclination $\theta_4$ of the motor 60 side portion is about 38° and the angle of inclination $\theta_5$ of the opposite side portion is about 21°, and in addition, the right part of the opposite side portion is bent upward at a predetermined point to have the angle of inclination $\theta_6$ lager than $\theta_5$. In this case, most of the low velocity areas in the first and second embodiments can be removed.

FIG. 12 is a graph illustrating static pressure values versus air flow rates according to experiments under a condition in which the rotational of speed of the impeller 51 was 3,050 RPM in each case for comparing the conventional fan and the first, second and third embodiments with each other. As can be seen in FIG. 12, at the same static pressures the air flow rates are increased in the fans according to the present invention in comparison with the conventional fan. FIG. 13 is a graph noise values (dB) versus air flow rates according to experiments for comparing the conventional fan and the first, second and third embodiments with each other. In all the fans, though the noise value increases as the air flow rate increases, it is found that at the same air flow rate the noise value is remarkably reduced in the fans according to the present invention in comparison with the conventional fan.

Figure 14:
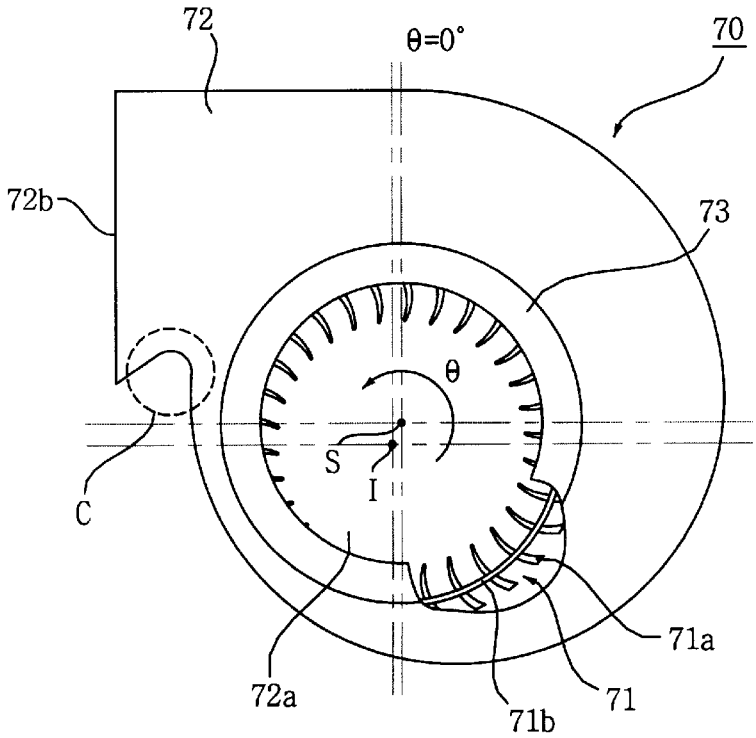
FIG. 14 is a front view illustrating a fan according to a fourth embodiment of the present invention.
Figure 15:
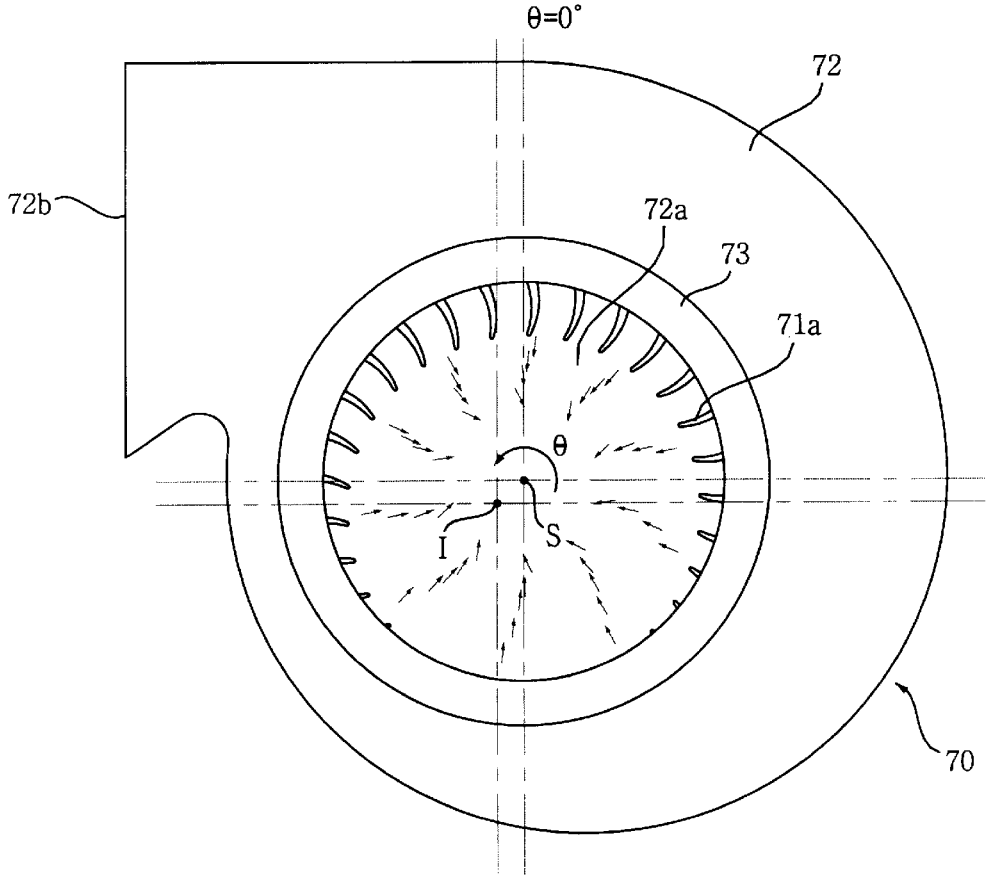
FIG. 15 is a front view of the fan according to the fourth embodiment of the present invention, in which a flow velocity distribution at an air inlet of the fan is expressed by velocity vectors.
Figure 16:
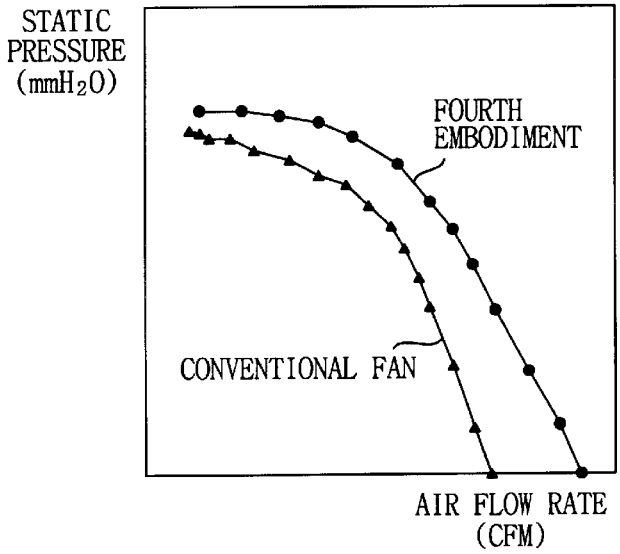
FIG. 16 is a graph illustrating variations of static pressure values versus air flow rates in the fan according to the fourth embodiment of the present invention and the conventional fan.
Figure 17:
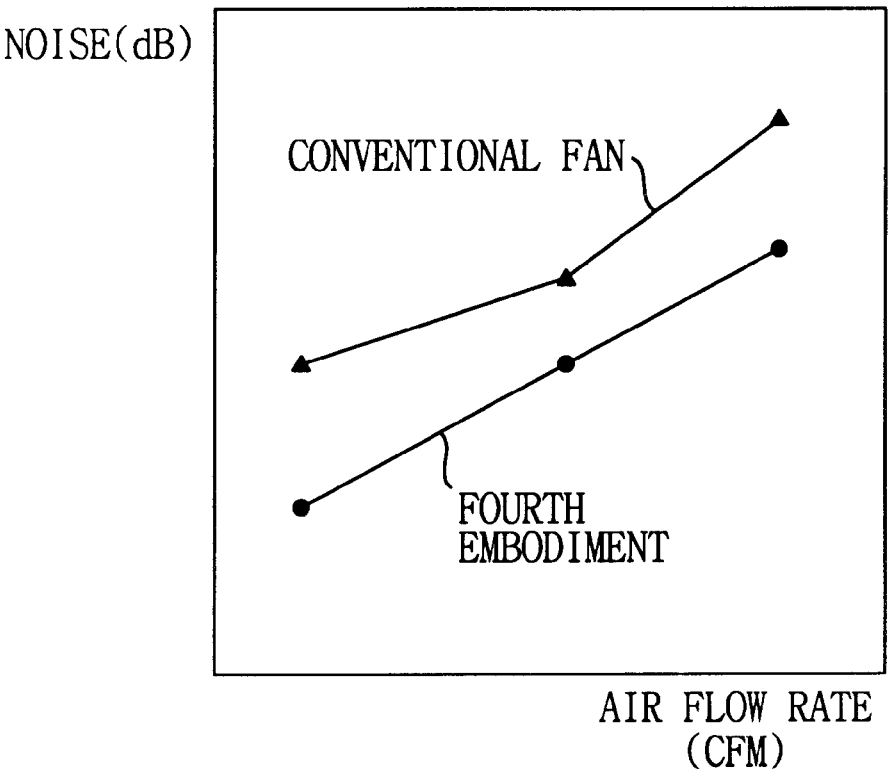
FIG. 17 is a graph illustrating variations of noise values versus air flow rates in the fan according to the fourth embodiment of the present invention and the conventional fan.

FIG. 14 is a front view illustrating a fan according to a fourth embodiment of the present invention, FIG. 15 is a front view of the fan according to the fourth embodiment of the present invention, in which a flow velocity distribution at an air inlet of the fan is expressed by velocity vectors, FIG. 16 is a graph illustrating variations of static pressure values versus air flow rates in the fan according to the fourth embodiment of the present invention and the conventional fan, and FIG. 17 is a graph illustrating variations of noise values versus air flow rates in the fan according to the fourth embodiment of the present invention and the conventional fan.

As shown in FIGS. 14 and 15, a fan 70 according to a fourth embodiment of the present invention is configured so that the rotation center I of an impeller and the center S of the air inlet of a scroll housing. That is, the rotation center I of the impeller is moved toward a cutoff C with respect to the center S of the air inlet of the scroll housing. In other words, when it is described in terms of the rotation angle θ with respect to the center S of the air inlet of the scroll housing, the fan is configured so that the rotation center I of the impeller is disposed at a position between 90° and 180° of the rotation angle θ to be eccentric by a predetermined distance with respect to the center S of the air inlet of the scroll housing.

In the above-described fan, when the impeller 71 rotates, air is drawn in through the air inlet 72*a* of the scroll housing 72. At this time, as can be seen in the flow velocity distribution of the drawn air shown in FIG. 15, the flow loss area which occurred in an area between −90° and 90° of the rotation angle is converted into an area where the drawn air flows uniformly. Reference numerals 71*a*, 71*b*, 72*b* and 73 indicate blades, rims, an exhaust outlet and a bell mouth, respectively.

In the fourth embodiment of the present invention, it is found that the air flow rate is increased at the same static pressure in comparison with the conventional fan, as shown in the graph of FIG. 16 illustrating static pressure values versus air flow rates , and the noise value is decreased in comparison with the conventional fan, as shown in the graph of FIG. 17 illustrating noise values versus air flow rates.

In addition, the fourth embodiment according to the present invention may be modified by combining it with the first, second and third embodiment. That is, the effect of the present invention can be enhanced by disposing the centers of the scroll housing and the impeller to be eccentric and at the same time, by forming the lower portion of an exhaust outlet to have at least one incline as in a V shape or the like.

As described above, in the fans 50, 50*a*, 50*b* and 70 according to the present invention, since the shape of the exhaust outlet 52*b* is changed so that the flow loss area formed at the exhaust outlet 52*b* of the scroll housing 52 can be decreased, and the rotation center I of the impeller and the center S of the air inlet of the scroll housing are disposed to be eccentric so that the flow loss area formed at the air inlet 72*a* of the scroll housing 72, the air flow rate can be increased while the noise value can be reduced.

What is claimed is:

1. A fan including:

an impeller on which a plurality of blades are installed for rotating so as to create air flow; and a scroll housing formed so that the air drawn in through an air inlet by the impeller can be guided along a gradually expanding passage of the scroll housing, and the lower portion of an exhaust outlet is composed of at least two incline surfaces diverging upwardly toward opposed side surfaces of the exhaust outlet.

2. The fan as claimed in claim 1, wherein the lower portion of the exhaust outlet including the two incline diverging surfaces is formed in a V shape.

3. The fan as claimed in claim 2, wherein the lower portion of the exhaust outlet is bent to form the two upward incline surfaces.

4. The fan of claim 1, wherein the scroll housing is formed so that the air drawn in through an air inlet by the impeller can be guided along the gradually expanding passage of the scroll housing, and the rotation center of the impeller and the center of the air inlet are disposed to be eccentric.

5. The fan as claimed in claim 4, wherein the rotation center I of the impeller is disposed at a position between 90° and 180° of the rotation angle θ to be eccentric by a predetermined distance with respect to the center S of the air inlet of the scroll housing.

* * * * *